US008885838B2

(12) United States Patent
Paludan-Muller et al.

(10) Patent No.: US 8,885,838 B2
(45) Date of Patent: Nov. 11, 2014

(54) METHOD OF PROCESSING A SIGNAL IN A HEARING AID, A METHOD OF FITTING A HEARING AID AND A HEARING AID

(75) Inventors: Carsten Paludan-Muller, Frederikssund (DK); Peter Magnus Norgaard, Vanlose (DK)

(73) Assignee: Widex A/S, Lynge (DK)

( * ) Notice: Subject to any disclaimer, the term of this patent is extended or adjusted under 35 U.S.C. 154(b) by 387 days.

(21) Appl. No.: 13/490,712

(22) Filed: Jun. 7, 2012

(65) Prior Publication Data

US 2012/0243693 A1 Sep. 27, 2012

Related U.S. Application Data

(63) Continuation-in-part of application No. PCT/DK2009/050327, filed on Dec. 9, 2009.

(51) Int. Cl.
*H04R 5/00* (2006.01)
*H04R 25/00* (2006.01)

(52) U.S. Cl.
CPC ..... *H04R 25/356* (2013.01); *H04R 25/70* (2013.01); *H04R 25/505* (2013.01); *H04R 2225/41* (2013.01); *H04R 2225/43* (2013.01)
USPC ..... 381/23.1; 381/321

(58) Field of Classification Search
USPC ..... 381/23.1, 321, 312, 317, 314, 316
See application file for complete search history.

(56) References Cited

U.S. PATENT DOCUMENTS

| | | | | |
|---|---|---|---|---|
| 5,202,927 | A | 4/1993 | Topholm | |
| 5,903,655 | A * | 5/1999 | Salmi et al. | 381/321 |
| 2008/0107296 | A1 | 5/2008 | Bachler et al. | |

FOREIGN PATENT DOCUMENTS

| | | | |
|---|---|---|---|
| EP | 0824845 | A1 | 9/1998 |
| EP | 1059016 | B1 | 5/2002 |
| EP | 1522206 | B1 | 10/2007 |
| EP | 1981309 | A1 | 10/2008 |

OTHER PUBLICATIONS

International Search Report for PCT/DK2009/050327 dated Jul. 28, 2010.

* cited by examiner

*Primary Examiner* — Paul S Kim
*Assistant Examiner* — Ammar Hamid
(74) *Attorney, Agent, or Firm* — Sughrue Mion, PLLC

(57) ABSTRACT

A method comprises deriving a control signal (3) from an input signal (1). The process of deriving the control signal comprises a standard processing (6) so as to provide a standard processed control signal component (7) based on a standard compressor characteristic, and an individualized processing (10) so as to provide an individualized processed control signal component (11) based on an individualized compressor characteristic. The standard and individualized processed control signal components are multiplied together to form the control signal. The invention further provides a hearing aid.

20 Claims, 5 Drawing Sheets

METHOD OF PROCESSING A SIGNAL IN A HEARING AID, A METHOD OF FITTING A HEARING AID AND A HEARING AID

RELATED APPLICATIONS

The present application is a continuation-in-part of application No. PCT/DK2009/050327, filed on Dec. 9, 2009, with the Danish Patent Office and published as WO-A1-2011069504.

BACKGROUND OF THE INVENTION

1. Field of the Invention

The present invention relates to hearing aids. More specifically, the invention relates to a method of processing a signal in a hearing aid. The invention further relates to a hearing aid implementing said method of processing a signal.

Basically, a hearing aid picks up an input signal and sends out a processed output signal. Said processing involves amplification of said input signal according to the user's needs. Amplification is carried out in an amplifier, usually including a compressor having a compressor gain.

Generally, the hearing loss of a hearing impaired is not linear. That is to say, the hearing ability may be almost normal at some sound pressure levels—typically at louder sound pressure levels, while being quite poor at other sound pressure levels—typically at softer sound pressure levels. The fact that amplification is needed especially for the softer sound pressure levels while not so much for the louder sound pressure levels is quite typical for many of the hearing impaired.

2. The Prior Art

State of the art hearing aids are adapted to compensate for this common pattern of hearing loss, by means of a compressor. The compressor is adapted for adjusting the gain so as to vary with the current sound pressure level of the input signal. The variation of the level dependent compressor gain is defined in a compression characteristic. A state of the art hearing aid may include a compression characteristic for each frequency band of the input signal.

Examples of hearing aids wherein the input signal is amplified in a compressor having a compressor gain that varies with sound pressure level in accordance with a compression characteristic are described in EP-B1-1059016 and EP-B1-0824845.

Traditionally, fitting of the hearing aid includes adjusting the compressor gain according to a general compression characteristic, in the following referred to as the standard rationale. The standard rationale takes into account the individual hearing loss, but is apart from that intended to accommodate the average hearing aid user.

However, even though the hearing loss of many hearing impaired follow the above-described pattern regarding the need for a larger amplification of softer sound pressure levels but not necessarily an equally large amplification of louder sound pressure levels, individual differences exist. The need for amplification for one hearing impaired may even vary greatly from that of another having a similar hearing loss.

In an effort to make a conventional hearing aid compensate better for the specific hearing loss and preferences of the individual user, the hearing aid is furthermore fine-fitted to the individual user. The fine-fitting is traditionally carried out as additional adjustments to the standard fitting according to the standard rationale.

One of the problems with the existing way of fine-fitting a hearing aid to the individual user is that the compressor only provides limited possibility for fine adjusting the compression characteristic so as to fit the hearing loss of the individual user sufficiently accurate. This is due to the fact that the number of adjustment points, in each of which the compression characteristic of the compressor can be adjusted independently of the other adjustment points, is traditionally very limited. In many cases, the compression characteristic only has two adjustment points. Hence, adjustment of the compressor gain for one sound pressure level influences that of many other sound pressure levels, which may not be desirable.

Hence, only a crude fitting of the compression characteristic to the hearing loss of the individual user is possible. This means that when fitting a hearing aid to an individual user, a compromise must be made between on one hand providing a sufficient amplification of the input signal for some sound input levels while on the other hand avoiding to amplify the input signal for other sound pressure levels to such an extent that the comfort level of the user is exceeded.

Another problem concerning the existing way of processing the input signal of a hearing aid is associated with signal optimisation. Implementation of various types of adaptive processing such as for instance speech intelligibility optimisation are becoming more widespread in the signal processing in hearing aids.

Unfortunately, fine-adjustments carried out on the compression characteristic during the fine-fitting of the hearing aid to the individual hearing aid user may be regarded as deviations from the optimal compression characteristic and may therefore to a great extent be eliminated or reduced by the adaptive processing. Hence, the effect of the fine-fitting of the hearing aid to the individual user is to a great extent never experienced by the user.

All in all, the existing method of processing and fitting has difficulties in meeting any requirement of individual deviation from the above described typical pattern of hearing loss of many hearing impaired.

Hence, a need for a more flexibly adjustable compressor gain exists so as to be able to fit the actual hearing loss and individual preferences of the hearing aid user better.

Also, there is a need for a manner of avoiding that the effect of any fine-fitting is reduced or eliminated by other processing in the hearing aid, such as for instance adaptive processing.

SUMMARY OF THE INVENTION

It is a feature of the present invention to alleviate or overcome at least some of the above-mentioned problems.

The invention, in a first aspect, provides a method of processing a signal in a hearing aid, comprising the steps of picking up an acoustical signal; deriving an input signal from the acoustical signal; deriving a control signal from the input signal; and processing the input signal in a signal processing device by multiplying the input signal with a number derived from said control signal so as to provide an output signal, where the process of deriving said control signal comprises estimating a signal level for the input signal hereby providing an input signal level estimate, executing a standard processing, including determining a standard control signal component in accordance with a standard compression characteristic, using the input signal level estimate as input to the standard compressor, executing an individualized processing, including determining an individualized control signal component in accordance with an individualized compression characteristic, using the input signal level estimate as input to the individualized compressor, executing an adaptive processing of the input signal using as input the standard control signal component so as to provide an adaptive control signal component, and multiplying the standard control signal component, the individualized control signal component and the adaptive control signal components to form the control signal, wherein the standard processing, the individualized processing and the adaptive processing are carried out in substantially the same frequency band.

Two separate and independent compressors are thus provided, i.e. a standard compressor with a standard compressor gain and an individualized compressor with an individualized compressor gain. The provision of two separate compressors is beneficial, as the standard compression characteristic of the standard compressor may be adjusted in accordance with a standard rationale, while the individualized compression characteristic may be adjusted in accordance with a fine-fitting profile of an individual hearing aid user.

The processing of the individualized compressor is independent of both the standard processing, and the adaptive processing. This means that when for instance fine-fitting is performed by means of the individualized compressor, the effect of the fine-fitting is maintained independent on the standard and the adaptive processing. As a result, it is achieved that the user of the hearing aid is actually able to experience the effect of fine-fitting of the hearing aid.

In a preferred embodiment according to the first aspect of the invention, the adaptive processing comprises optimisation of a speech intelligibility index (SII). A process for optimisation of a speech intelligibility index (SII) is further described in e.g. EP-B1-1522206.

In this case it is particularly beneficial to carry out the standard fitting by means of the standard compressor and the fine-fitting by means of the individualized, independent compressor, since adaptive processing such as optimization of SII, finds an optimum compression characteristic based on a multitude of inputs. Deviations from the found optimum compression characteristic are therefore attempted eliminated or reduced accordingly. Since the fine-fitting is carried out by means of the individualized compressor, which is independent of the standard compressor, the effect of the fine-fitting will not be sought eliminated by the adaptive processing, and hence the user gets to experience the effect of the fine fitting.

In other embodiments according to the first aspect of the invention, the adaptive processing comprises adaptive optimisation of loudness or comfort.

In an embodiment of the first aspect of the present invention, said individualized compressor gain control output is variable as a function of time.

The effect is that acclimatization is rendered possible. By acclimatization is understood that a user of a hearing aid is being given a certain period of time to gradually become accustomed to the standard fitting of the hearing aid without having to perform any adjustments in the course of that time period.

Acclimatization may be performed in a number of ways. In one embodiment according to the first aspect of the present invention, it is obtained in that the value of said individualized compressor gain control output increases within a predetermined time.

The fact that the value of the individualized compressor gain control output increases with time, gives an opportunity to introduce a damping of the amplification of the hearing aid, which damping is gradually removed with time.

In one embodiment according to the first aspect of the present invention, said individualized compression characteristic is adjustable using a number of predetermined adjustment points distributed over a range of input levels.

Preferably there are more than two adjustment points, more preferably there are between 5 and 20 adjustment points, and most preferably there are 8-12 adjustment points over said range of input levels.

The fact that more adjustment points are provided compared to the prior art compressor has the advantage that a more flexible adjustment of the individualized compressor is obtained. This allows executing a very precise adjustment that is more likely to fit the hearing loss and individual preferences of the user accurately, since the adjustment of the individualized compressor gain for one sound pressure level does not affect the individualized compressor gain for many other sound pressure levels. That means that a user's possible need for large amplification in one range of sound pressure levels but almost none for other sound pressure levels can be met to a greater extent than before.

Also, in the embodiment discussed above, where an individualized compressor is used for acclimatization purposes, a better compensation of the user's hearing loss is possible with a flexible individualized compression characteristic with a large number of adjustment points.

In an embodiment according to the first aspect of the present invention, said input signal is a sound pressure level and the spacing between the adjustment points is selected within the range of 2 dB to 20 dB, and preferably within the range of 5 dB to 10 dB.

This spacing between adjustment points has proved to be an appropriate compromise between achieving a proper resolution in order to obtain a sufficiently flexible adjustment of the individualized compression characteristic while keeping the complexity of the hearing aid at a suitable level.

In an embodiment according to the first aspect of the present invention said standard compression characteristic is adjustable using a number of predetermined adjustment points distributed over a range of input levels and said individualized compression characteristic has more adjustment points than said standard compression characteristic.

It is beneficial to have the possibility of adjusting the individualized compression characteristic in more adjustment points than the standard compression characteristic, since the individualized compression characteristic corresponds to the fine-fitting of the hearing aid. The need for more detailed control is larger for the fine-fitting than for the standard fitting taking place by means of the standard compression characteristic.

An individualized compression characteristic with many adjustment points for fine-fitting complements a standard compression characteristic with fewer adjustment points for standard fitting well.

In an embodiment according to the first aspect of the present invention, said individualized processing includes determining for said input signal a plurality of parallel individualized compressor gain control outputs in accordance with a corresponding plurality of respective individualized compression characteristics, each respective individualized compression characteristic being adjustable independently of the others.

Having a number of parallel individualized compressors provides for the possibility of a more complex fine-fitting of the hearing aid to a hearing aid user, where each of the individualized compressors may be fine-fitted for each a different sound situation, such as listening to music, to a speaker at a conference or to multiple, simultaneous conversations at for instance a cocktail party.

The invention, in a second aspect provides a hearing aid comprising means for picking up an acoustical signal; means for deriving an input signal from the acoustical signal; means for deriving a control signal from the input signal; means for amplifying the input signal in accordance with the control signal hereby providing an output signal; and means for converting the output signal into an acoustical signal, wherein the means for deriving the control signal includes: a signal level estimator for providing an input signal level estimate, a standard compressor adapted for processing the input signal level estimate according to a standard compressor characteristic for providing a standard control signal component, an individualized compressor adapted for processing the input signal level estimate according to an individualized compressor characteristic for providing an individualized control signal component, adaptive processing means adapted for processing the input signal and the standard control signal component for providing an adaptive control signal component, and multiplication means for multiplying together the standard control signal component, the individualized control signal component and the adaptive control signal component to form the control signal.

BRIEF DESCRIPTION OF THE DRAWINGS

In the following, embodiments of the different aspects of the invention will be described by way of example and accompanied by schematic drawings, in which.

DETAILED DESCRIPTION OF THE INVENTION

Figure 1:
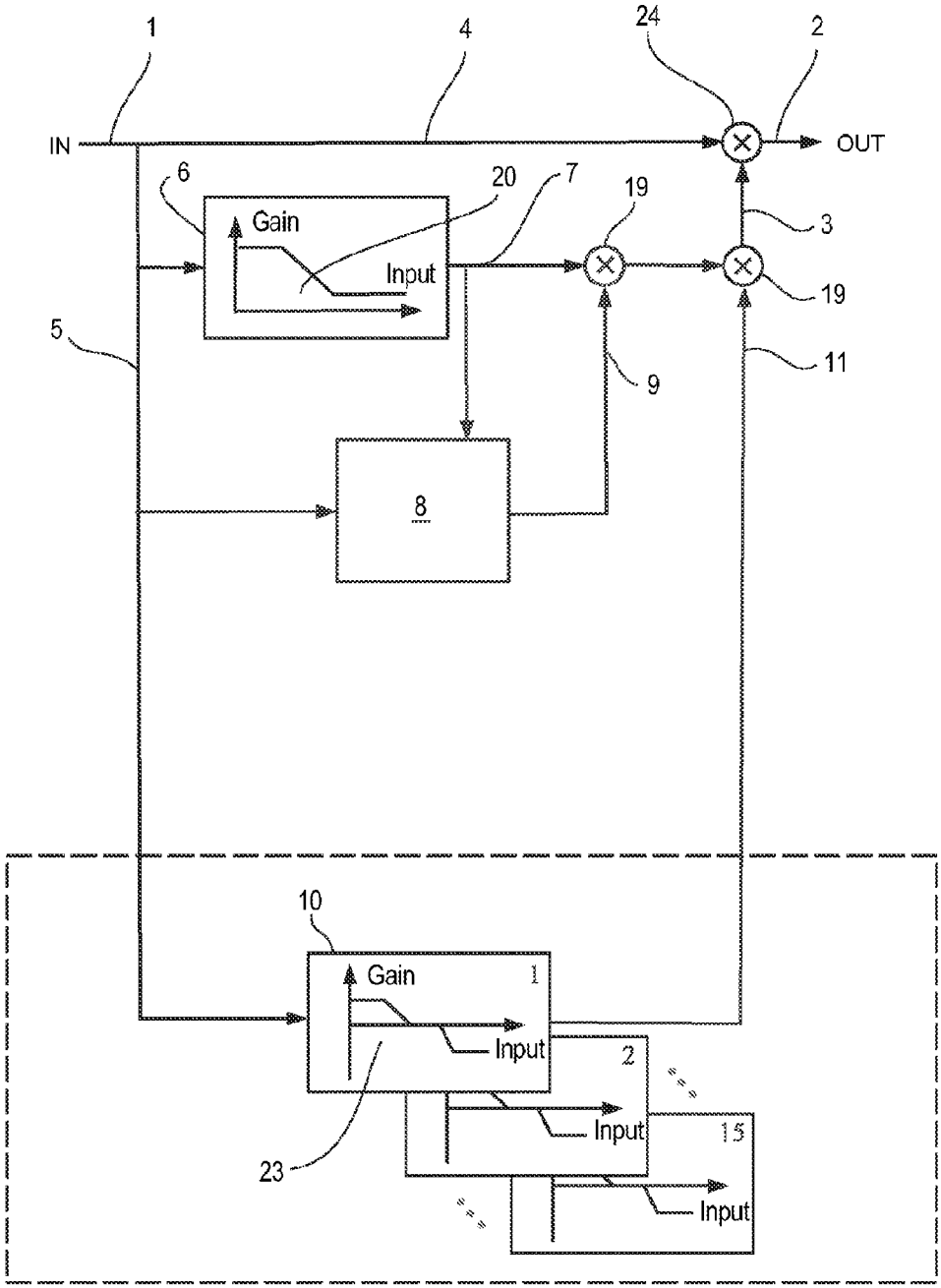
FIG. 1 is a diagrammatic flow chart representing a further embodiment according to the first aspect of the present invention.

In the following, similar features are denoted with the same reference numerals.

Referring first to the embodiment shown in FIG. 1, an input signal 1 is picked up at the location marked 'IN'. Normally, the input signal 1 is at this point already split in various frequency bands. In the following, if nothing else is stated, it is understood that the input signal has already been split up in frequency bands, among which one is illustrated in FIG. 1. An output signal 2 is sent out at the location marked 'OUT'. A control signal 3 is derived from the input signal 1. In multiplication point 24 the input signal 1 is multiplied by a number derived from said control signal 3 to provide the output signal 2.

A signal path 4 extends between 'IN' and 'OUT'. The paths, which extend below the signal path 4 in FIG. 1, form control signal paths. In the following, if nothing else is stated, it is understood that the level of the input signal 1 in the control signal paths is estimated by signal level estimation means (not shown) before being applied as input to the various processings.

The process of deriving the control signal 3 from the input signal 1 comprises a standard processing 6 taking place in a standard compressor. The standard processing 6 includes determining for the input signal 1 a standard compressor gain control output in accordance with a standard compression characteristic 20, e.g. in accordance with the standard rationale. Hereby a standard processed control signal component 7 is provided.

The process of deriving the control signal 3 from the input signal 1 further comprises at least one adaptive processing 8 of the input signal 1. In FIG. 1 only a single adaptive processing 8 is depicted, but evidently there could be more. The adaptive processing 8 uses the standard processed control signal component 7 to provide an adaptive processed control signal component 9.

The process of deriving the control signal 3 from the input signal further comprises an individualized processing 10, which is independent of both the standard 6 and the adaptive 8 processing and takes place in an individualized compressor. The individualized processing 10 is independent of the standard 6 and adaptive 8 processing, as only the input signal 1 serves as input for the individualized processing 10. The individualized processing 10 includes determining for the input signal 1 an individualized compressor gain control output in accordance with an individualized compression characteristic 23 to provide an individualized processed control signal component 11. As will be explained below, this individualized processing could e.g. constitute a fine-fitting.

The standard 7, adaptive 9 and individualized 11 processed control signal components are multiplied together in an appropriate number of multiplication points 19 to form said control signal 3. The control signal components may represent values that are given in dB, in which case the multiplication is replaced by a summation. This will be readily appreciated by one skilled in the art.

As the input signal 1 has already been split into frequency bands prior to 'IN' in the figure, the standard 6, adaptive 8 and individualized 10 processing are carried out in the same frequency band. It is understood that the processing displayed in FIG. 1 takes place for each frequency band of the hearing aid. This is illustrated by the underlying partly concealed individualized processing blocks 10. The presence of up to around fifteen frequency bands is quite normal for modern hearing aids.

As is seen, both the standard processed control signal component 7 and the input signal 1 serve as inputs for the adaptive processing 8. The adaptive processing 8 thus depends on the standard processing 6. Contrarily, the individualized processing 10 is independent of both the standard processing 6 and the adaptive processing 8 in the sense that only the input signal 1 is input to the individualized processing 10, as mentioned above. This way, the standard processing 6 may be used to implement a standard fitting of the hearing aid, while the individualized processing 10 may be used to implement a fine-fitting of the hearing aid to the individual user, since the fine-fitting this way will not be eliminated by the adaptive processing.

The adaptive processing 8 could be various types of adaptive processing. In the embodiment shown, there is a single block representing an adaptive process for optimisation of SII. Embodiments with more kinds of adaptive processing are of course also conceivable.

Figure 2:
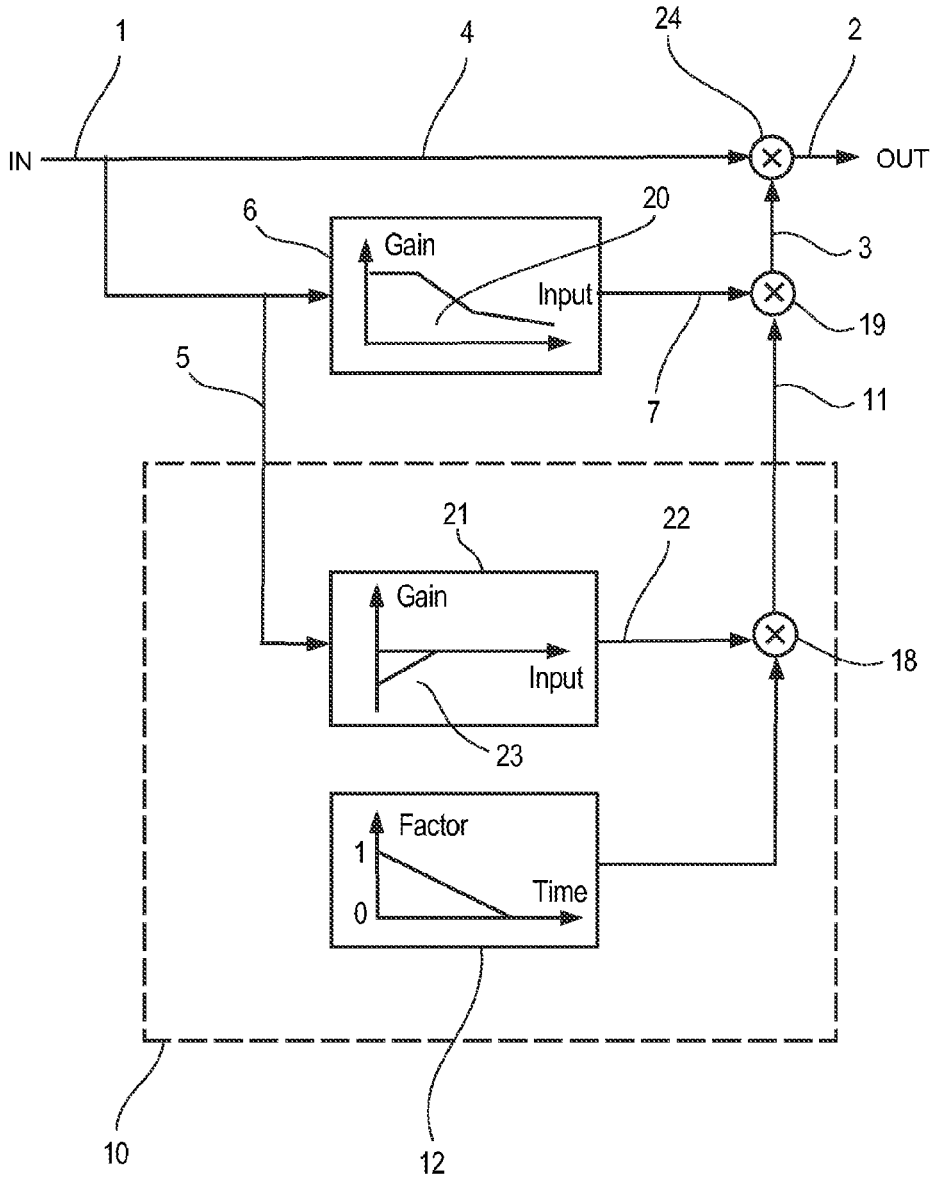
FIG. 2 is a diagrammatic flow chart representing another embodiment according to the first aspect of the present invention.

Now referring to FIG. 2, another embodiment according to the first aspect of the invention is shown. In this embodiment, the individualized processing 10 is used for acclimatization purposes. It is a fact that many hearing impaired have suffered from a reduced sense of hearing for quite some time before they are equipped with a hearing aid. Hence, they have become used to perceiving only a reduced part of the sound environment from their surroundings. Suddenly being able to hear well again with the aid of a hearing aid may be an overwhelming experience, which is why in many cases a period of acclimatization is needed.

In a preferred embodiment of the invention, the individualized compression characteristic of the individualized compressor used for acclimatization is set to suppress sound pressure levels at frequencies that correspond to the sound pressure levels and frequencies that the hearing impaired does not experience or only experiences to a limited degree when not wearing the hearing aid. The individualized compressor is thus used to mimic the hearing loss of the hearing aid user. When the damping, which mimics the hearing loss, is gradually eliminated, it has the effect that the user is progressively becoming accustomed to the amplification of the hearing aid.

In the embodiment shown in FIG. 2, the individualized processing 10, which is independent of the standard processing 6, includes determining for the input signal 1 an individualized compressor gain control output 22 in accordance with an individualized compression characteristic 23.

The individualized processing 10 further includes multiplication of the individualized compressor gain control output 22 by a multiplication factor 12, which varies with time, so as to provide an individualized processed control signal component 11. The multiplication takes place in multiplication point 18.

As is indicated in FIG. 2, the individualized compression characteristic 23 is configured to provide a negative amplification of the input signal 1. The multiplication factor 12 is, as indicated, gradually decreasing from a value of 1 to a value of 0 over a period of time needed for the acclimatization. The duration of the acclimatization period may vary from one user to another but typically lasts for some months. In the embodiment shown, the acclimatization period lasts for three months.

According to an embodiment the variation of the multiplication factor is determined based on a usage log in the hearing aid. Hereby it is secured that the progress of the acclimatization only depends on the time the hearing aid has been used.

Similar to the embodiment of FIG. 1, the input signal 1 is picked up at 'IN' and the output signal 2 is sent out at 'OUT'. A signal path 4 extends between 'IN' and 'OUT', and the control signal 3 is derived from the input signal 1. In multiplication point 24 the input signal 1 is multiplied by a number derived from said control signal 3 to provide the output signal 2. The paths, which extend below the signal path 4, form control signal paths.

The process of deriving the control signal 3 from the input signal 1 comprises, besides the above-mentioned individualized processing, a standard processing 6, which includes determining for the input signal 1 a standard compressor gain control output in accordance with a standard compression characteristic 20. A standard processed control signal component 7 is thereby provided.

Although not shown in FIG. 2, the presence of one or more kinds of adaptive processing as discussed above is of course also conceivable in this embodiment. The standard 7 and individualized 11 processed control signal components are multiplied together in an appropriate number of multiplication points 19 to form said control signal 3.

According to another embodiment two or more individualized processings can be combined, e.g. for implementing both acclimatization and fine fitting.

Figure 3:
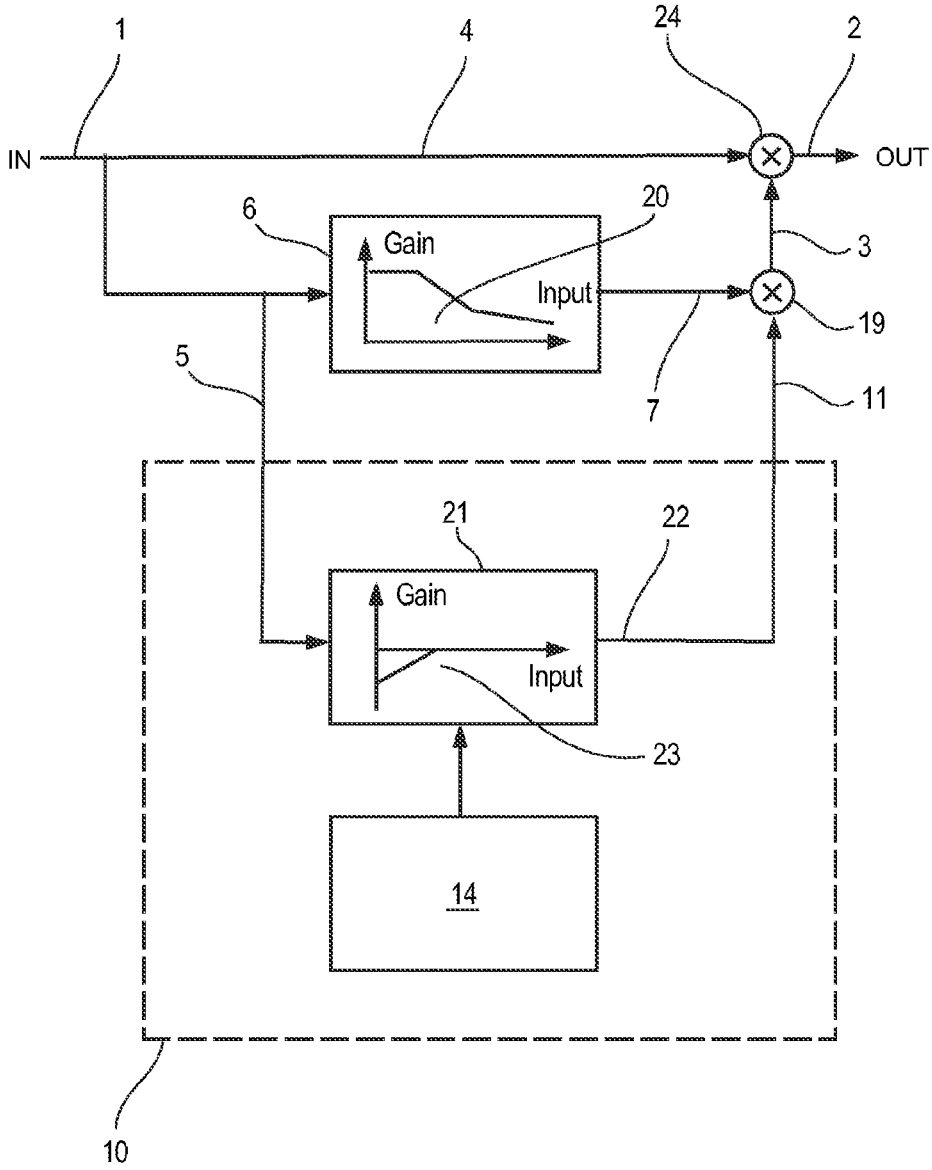
FIG. 3 is a diagrammatic flow chart representing a further embodiment according to the first aspect of the present invention.

FIG. 3 presents an alternative way of implementing acclimatization. The embodiment of FIG. 3 is corresponding to that of FIG. 2 in that it presents an input signal 1, an output signal 2, a control signal 3, a signal path 4 and control signal paths. In multiplication point 24 the input signal 1 is multiplied by a number derived from said control signal 3 to provide the output signal 2. Also a standard processing 6 and an individualized processing 10 takes place providing standard 7 and individualized 11 processed control signal components, which are multiplied together in an appropriate number of multiplication points 19 so as to form the control signal 3. However, the acclimatization is in this embodiment controlled by the user as indicated by block 14 representing user input. The user is free to control the level of suppression.

The skilled person will understand that the application of user control is not limited to acclimatization, but may also be applicable in connection with for instance the fine-fitting of the hearing aid.

Another alternative way of implementing a form of acclimatization is by increasing the value of the individualized compressor gain control output within a predetermined time. Where the increase is achieved by means of a multiplication factor, the individualized compressor may be set to a final individualized compression characteristic and the multiplication factor to increase from a value of 0 to a final value of 1 over a specified period of time to obtain the required acclimatization effect. However, this solution is not preferred, as there is no initial damping that mimics the hearing loss of the hearing aid user, only a gradual introduction of a fine-fitting.

In either embodiment, when acclimatization is over, the individualized compressor may be used for fine-fitting of the hearing aid. Alternatively, a further individualized compressor may be provided so that one individualized compressor is used for undertaking the fine-fitting of the hearing aid and one individualized compressor is used for undertaking the acclimatization.

In another embodiment a set of individualized compression characteristics are stored in the hearing aid, where each of the individualized compression characteristics is adapted to a given stage of acclimatization. At a given stage in the acclimatization process a corresponding individualized compression characteristic is selected from the stored set to be used in the hearing aid. According to a specific embodiment four of such individualized compression characteristics are stored in the hearing aid.

According to an embodiment the stage of the acclimatization process, and thus the individualized compression characteristic to be selected, is determined in response to a usage log in the hearing aid. Hereby it is secured that the progress of the acclimatization only depends on the time the hearing aid has been used.

In yet another embodiment the stage of the acclimatization process is determined in response to a comparison of the usage logs in a first hearing aid and a second hearing aid respectively, where the two hearing aids together form a binaural hearing aid system. In a specific embodiment the two hearing aids are synchronized in order to ensure that the acclimatization stage is the same in the two hearing aids. According to an embodiment this is done by wirelessly exchanging a parameter representing the lapse of acclimatization time in each of the two hearing aids. According to an embodiment the most advanced stage of acclimatization is chosen for both hearing aids in case the parameter representing the lapse of acclimatization time implies different stages of acclimatization in the two hearing aids.

In an embodiment the hearing aid user is capable of overruling the automatically determined stage of acclimatization, hereby ensuring that the stage of acclimatization is in accordance with the users preferences.

According to one embodiment the stage of acclimatization is changed through manipulation of a user input in the hearing aid.

According to another embodiment the stage of acclimatization is changed when the hearing aid recognizes a given sequence of Dual-Tone Multi-Frequency tones (DTMF). In a typical situation the hearing aid user may call up a dispenser and ask the dispenser to produce the required sequence of DTMF tones in the hearing aid user's telephone by pressing the corresponding keys on the dispenser's telephone while the hearing aid user holds the telephone speaker close to the hearing aid microphones. It is to be appreciated that the acclimatization process according to the invention is very well suited for this type of remote controlling because the DTMF tones are only required to transmit a simple command that allows the preferred stage of acclimatization to be selected, hereby selecting the appropriate individualized compression characteristic. In this manner inconvenient visits to the dispenser can be avoided, being replaced by a simple telephone call.

In another embodiment the automatic determination of acclimatization stage is carried out at power-up of the hearing aids, and the result of the automatic determination of the acclimatization stage is communicated to the user through a pre-recorded sound message played in the hearing aids.

Figure 4:
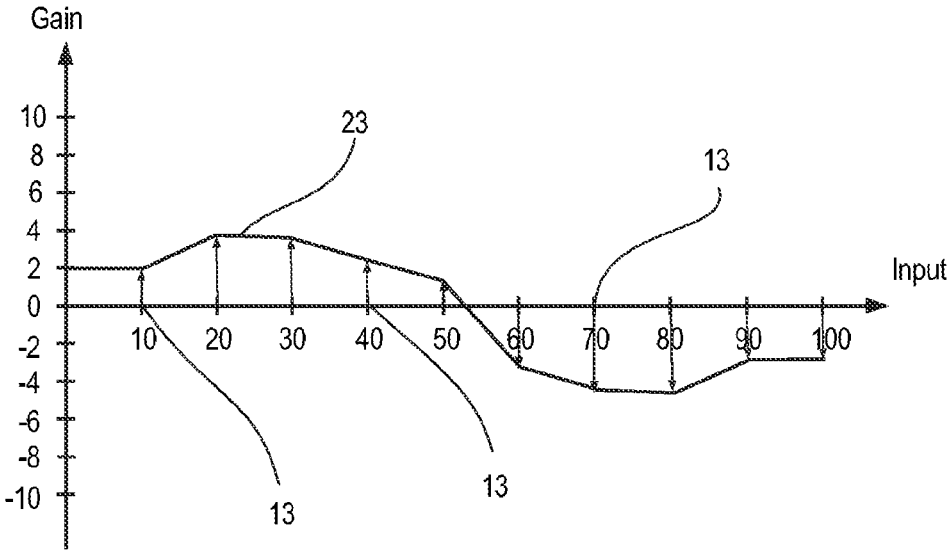
FIG. 4 represents an example of an individualized compression characteristic.

Turning now to FIG. 4, this shows an example of an individualized compression characteristic 23 as e.g. used in the first embodiment according to the first aspect of the invention, but in principle applicable to any of the previous embodiments according to the first aspect of the invention. In any of those embodiments, the standard compression characteristic may be adjusted in accordance with a standard rationale, while the individualized compression characteristic may be adjusted in accordance with a fine-fitting profile of an individual hearing aid user.

As is seen in FIG. 4, the individualized compression characteristic 23 provides a sound pressure level dependent amplification of an input signal. The input sound pressure level is measured in dB, and the amplification is expressed in terms of a gain, also measured in dB.

As can be seen, the individualized compression characteristic 23 shown in FIG. 4 is configured to amplify the softer sound pressure levels to a greater extent than the louder sound pressure levels. Actually, the louder sound pressure levels are even dampened due to the negative amplification in the example shown.

Each arrow extending from the abscissa in FIG. 4 represents an adjustment point 13. An adjustment point is a point, in which the compression characteristic 23 may be adjusted without influencing the compression characteristic 23 in other adjustment points 13.

As is seen, an adjustment point 13 is provided for every 10 dB of the input sound pressure level. A higher or lower resolution of adjustment points is of course conceivable. Preferably, the pitch or spacing between two adjacent adjustment points 13 is selected within the range of 2 dB to 20 dB, and preferably within the range of 5 dB to 10 dB.

An adjustment point for substantially every 10 dB of input sound pressure level has proven to be a suitable compromise between on one hand obtaining a sufficiently flexible adjustment of the individualized compression characteristic while on the other hand keeping the complexity of the hearing aid at a suitable level.

In the exemplary embodiment shown in FIG. 4, the adjustment points 13 are distributed equidistantly over the range of input sound pressure levels. This provides for simple implementation. Other arrangements are of course conceivable.

According to an embodiment, the pitch of the adjustment points is selected using an exponential function with a base of 2 and an exponent that is selected from the natural numbers. According to a preferred embodiment a pitch of 8 dB is selected. According to a further embodiment the gain values of the adjustment points are stored in a simple look-up table, numbered from one and up. For any given input sound pressure level the adjacent adjustment points and the corresponding gain values are required in order to determine, based on interpolation, the relevant gain. Having a pitch of 8, the numbers in the look-up table containing the gain values of the adjacent adjustment points can be determined by simply shifting the binary representation of the value of the input sound pressure level three places to the left. Hereby a very efficient digital implementation is provided.

The individualized compression characteristic 23 of FIG. 4 is a continuous function of the input sound pressure level. That ensures that no jumps or discontinuities occur in the individualized compressor gain, and hence in the amplification, which could otherwise lead to bad sound quality.

Still, in practice limitations exist as to the possible variation of the individualized compression characteristic 23 from one adjustment point 13 to an adjacent adjustment point 13. A compression characteristic with a too large difference between the gain values of two adjacent adjustment points may cause bad sound quality. For instance, an individualized compression characteristic presenting a gain of 15 dB for a sound pressure level of 30 dB, while presenting a gain of −15 dB for a sound pressure level of 40 dB at the same frequency is an example of a variance from one adjustment point to an adjacent adjustment point being too large to result in proper sound quality.

Figure 5:
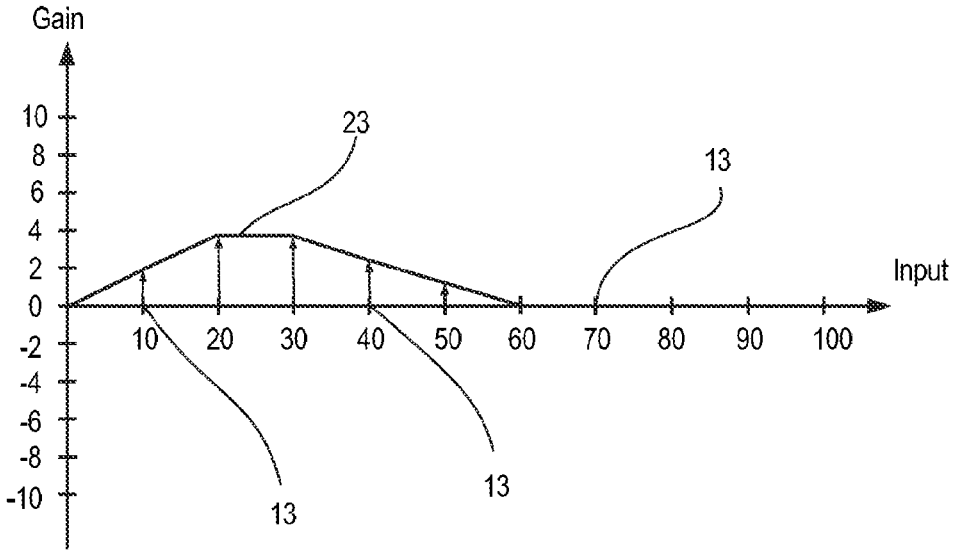
FIG. 5 represents another example of an individualized compression characteristic.

FIG. 5 shows another example of an individualized compression characteristic 23, which is expressing the individualized compressor gain as a continuous function of the input sound pressure level. Adjustment points 13 are distributed equidistantly over the entire input range. As is seen, this particular individualized compression characteristic 23 provides amplification of the softer sound pressure levels, and yet no amplification of the louder sound pressure levels.

The individualized compression characteristic 23 of FIG. 5 would for instance be suitable for a user having an almost normal hearing as to the louder sound pressure levels, say between 60 dB-100 dB, in the particular frequency band, while at the same time experiencing a rather severe hearing loss as to the softer sound pressure levels, say between 0 dB-50 dB, as the individualized compression characteristic 23 provides almost no amplification of the input signal for the louder sound pressure levels and yet at the same time amplifies the input signal for the softer sound pressure levels.

This illustrates the flexibility of the adjustment possibilities of the individualized compression characteristic. Whereas the exemplary compression characteristic of FIG. 4 may fit one individual hearing aid user, the exemplary compression characteristic of FIG. 5 may fit another individual hearing aid user.

Although not described in detail herein, the standard compression characteristic of the standard compressor in any of the embodiments according to the first aspect of the invention may of course also be adjustable using a number of predetermined adjustment points distributed over a range of input levels as described above for the individualized compression characteristic of the individualized compressor.

Preferably, however, said individualized compression characteristic still has more adjustment points than said standard compression characteristic. Thereby the standard compression characteristic may be adjusted in accordance with a standard rationale, while the individualized compression characteristic may be adjusted in accordance with a fine-fitting profile of an individual hearing aid user.

Furthermore, by using the existing standard compressor as basis for the further addition of an individualized compressor, the advantages of a proven design, facilitated implementation and adjustment are obtained. Thus, the further functionalities of the individualized compressor are provided without unnecessarily increasing the overall complexity of the hearing aid.

Although not preferred, an embodiment where said standard compressor has as many as, or more adjustment points than, said individualized compressor is of course also conceivable.

Figure 6:
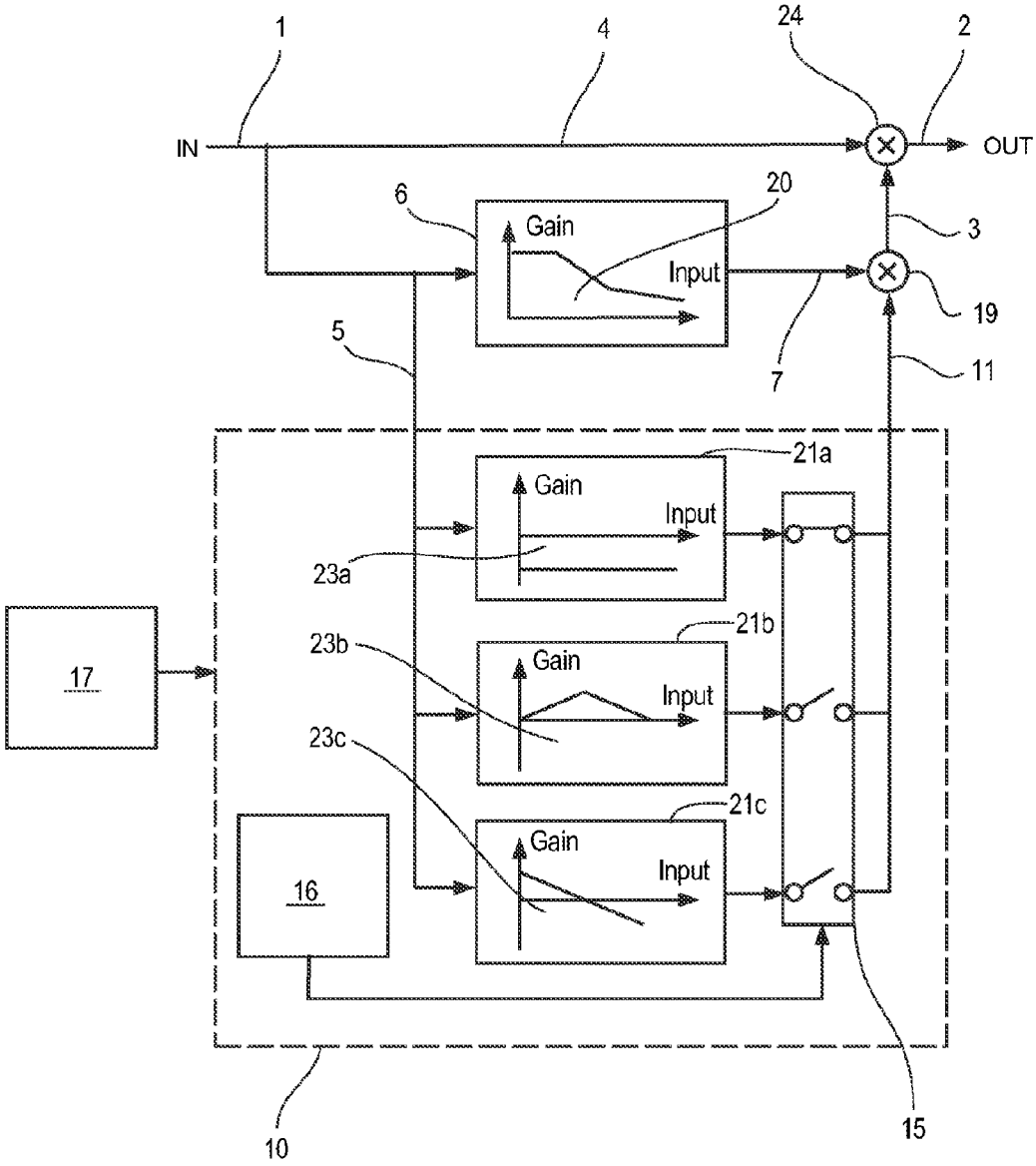
FIG. 6 is a diagrammatic flow chart representing yet another embodiment according to the first aspect of the present invention.

Turning now to FIG. 6, yet another embodiment of the present invention according to the first aspect of the present invention is shown. The embodiment in FIG. 6 is generally similar to the embodiment shown in FIG. 1, however, the individualized processing 10 of the embodiment of FIG. 6 comprises three parallel individualized compressors 21*a*, 21*b* and 21*c*, each having respective individualized compression characteristics 23*a*, 23*b* and 23*c*. Each respective individualized compression characteristic 23*a*, 23*b*, 23*c* is adjustable independently of the others.

This embodiment is particularly useful in connection with sound environment specific fine-fitting. "Sound environment" in this context means an environment, in which certain acoustic conditions prevail. Examples of different sound environments may be listening to music, listening to a lecture, listening to simultaneous conversations in a crowd such as at a party, being in nearly quiet surroundings or being in some sort of vehicle such as in a car, bus or train.

Different sound environments may require different fine-fitting of the hearing aid. For instance, an individualized compressor which is fine-fitted for the sound environment of listening to a lecture may be set to amplify sound pressure levels and frequencies typical for speech. Another individualized compressor which is fine-fitted for the sound environment of listening to music may be set to amplify frequencies corresponding to treble or bass according to individual requirements of the hearing aid user.

As is indicated in FIG. 6, each individualized compression characteristic 23*a*, 23*b*, 23*c* is configured differently from the others. In the embodiment shown the topmost individualized compressor 21*a* has an individualized compression characteristic 23*a* that provides an equally large amplification over the entire input range. The midmost individualized compressor 21*b* has an individualized compression characteristic 23*b* that is configured to provide little or no amplification in the softer as well as in the louder sound pressure input levels, while providing more amplification of the intermediate sound pressure input levels. The bottommost individualized compressor 21*c* has an individualized compression characteristic 23*c* that is configured to provide amplification at the softer sound pressure input levels, and a negative amplification at the louder sound pressure input levels, while little or no amplification at the intermediate sound pressure input levels. The illustrated individualized compressor characteristics 23*a*, 23*b* and 23*c* are chosen arbitrarily and are not meant to be specifically suited for any given sound situation.

As indicated by switch 15, only one individualized compressor is switched in at a time, namely that individualized compressor, whose compression characteristic corresponds to the prevailing sound environment.

A classifier 16 is able to distinguish between a number of predetermined different acoustic conditions. On basis of that, the classifier is able to decide which sound environment prevails at a certain moment and switch in an individualized compressor with an individualized compression characteristic corresponding to that sound environment. An example of a classifier is given in U.S. Pat. No. 5,202,927.

Means for obtaining a smooth transition from one individualized compression characteristic to another individualized compression characteristic may be provided to obtain a more continuous sound experience especially when the user is in an environment in which more simultaneous sound situations rival.

A possibility for the user him- or herself to switch between the different individualized compressors 21*a*, 21*b*, 21*c* may be provided. The possibility of a user input is indicated by the block 17 in FIG. 6. The user input 17 may be provided as an alternative to the classifier 16 or, as shown, in addition to the classifier 16.

It is to be understood that the invention is not limited to the embodiments shown and/or described in the above. Various modifications and variations may be carried out without departing from the scope the appended claims.

We claim:

1. A method of processing a signal in a hearing aid, comprising the steps of:

picking up an acoustical signal;

deriving an input signal from the acoustical signal;

deriving a control signal from the input signal; and processing the input signal in a signal processing device by multiplying the input signal with a number derived from said control signal so as to provide an output signal, where the process of deriving said control signal comprises:

estimating a signal level for the input signal hereby providing an input signal level estimate, executing a standard processing, including determining a standard control signal component in accordance with a standard compression characteristic, using the input signal level estimate as input to the standard compressor, executing an individualized processing, including determining an individualized control signal component in accordance with an individualized compression characteristic, using the input signal level estimate as input to the individualized compressor, executing an adaptive processing of the input signal using as input the standard control signal component so as to provide an adaptive control signal component, and multiplying the standard control signal component, the individualized control signal component and the adaptive control signal components to form the control signal, wherein the standard processing, the individualized processing and the adaptive processing are carried out in substantially the same frequency band.

2. The method according to claim 1, comprising the step of setting the individualized compression characteristic to mimic the hearing loss of the intended hearing aid user.

3. The method according to claim 1, comprising the step of multiplying the individualized control signal component by an acclimatization parameter that is variable as a function of time.

4. The method according to claim 3, comprising the step of decreasing the acclimatization parameter after the lapse of a predetermined acclimatization time span.

5. The method according to claim 1, comprising the step of selecting an individualized compression characteristic among a number of predetermined individualized compression characteristics in response to the lapse of a predetermined acclimatization time span.

6. The method according to claim 1, comprising the step of determining the lapse of acclimatization time based on the status of a hearing aid usage log.

7. The method according to claim 1, comprising the steps of:

exchanging, between a first and a second hearing aid in a binaural hearing aid system, a first and a second parameter representing the lapse of acclimatization time in the first and the second hearing aid respectively, comparing, said parameters in the first and the second hearing aid respectively, selecting a common stage of acclimatization, in the binaural hearing aid system, based on this comparison.

8. The method according to claim 7, comprising the step of selecting the most advanced stage of acclimatization.

9. The method according to claim 1, wherein the step of determining an individualized control signal component comprises selecting an individualized compression characteristic among a number of predetermined individualized compression characteristics in response to a user interaction.

10. The method according to claim 1, comprising the steps of: producing a given sequence of Dual-Tone-Multi-Frequency (DTMF) tones; having the hearing aid recognize said tones; and changing the stage of acclimatization dependent on the recognized tones.

11. The method according to claim 10, wherein the adaptive processing comprises optimisation of a speech intelligibility index.

12. The method according to claim 1, wherein the individualized compressor characteristic is set according to the individual preferences of the intended user.

13. The method according to claim 1, comprising the step of adjusting the individualized compression characteristic using a number of predetermined adjustment points distributed over a range of compressor input levels.

14. The method according to claim 13, where the pitch of the adjustment points is selected within the range of 2 dB-20 dB, and preferably 5 dB-10 dB.

15. The method according to claim 13, where the pitch of the adjustment points is selected using an exponential function with a base of 2 and an exponent that is selected from the natural numbers.

16. The method according to claim 15, where the pitch of the adjustment points is selected to be 8 dB.

17. The method according to claim 1, wherein the standard compression characteristic is adjustable using a number of predetermined adjustment points distributed over a range of compressor input levels, and wherein the individualized compression characteristic has more adjustment points than said standard compression characteristic.

18. The method according to claim 1, wherein the step of determining an individualized control signal component comprises:

determining a plurality of individualized compression characteristics corresponding to a plurality of sound environments, and selecting an individualized control signal component in accordance with an individualized compression characteristic corresponding to a current sound environment.

19. A hearing aid comprising:

means for picking up an acoustical signal;

means for deriving an input signal from the acoustical signal;

means for deriving a control signal from the input signal;

means for amplifying the input signal in accordance with the control signal hereby providing an output signal;

and means for converting the output signal into an acoustical signal, wherein the means for deriving the control signal includes: a signal level estimator for providing an input signal level estimate, a standard compressor adapted for processing the input signal level estimate according to a standard compressor characteristic for providing a standard control signal component, an individualized compressor adapted for processing the input signal level estimate according to an individualized compressor characteristic for providing an individualized control signal component, adaptive processing means adapted for processing the input signal and the standard control signal component for providing an adaptive control signal component, and multiplication means for multiplying together the standard control signal component, the individualized control signal component and the adaptive control signal component to form the control signal.

20. The hearing aid according to claim 19, wherein the adaptive processing means is adapted for optimising a speech intelligibility index.

* * * * *